US005924779A

United States Patent [19]

Krumholz

[11] Patent Number: 5,924,779

[45] Date of Patent: Jul. 20, 1999

[54] MUSIC LIBRARY SYSTEM

[75] Inventor: Frank C. Krumholz, Owatonna, Minn.

[73] Assignee: Wenger Corporation, Owatonna, Minn.

[21] Appl. No.: 08/958,327

[22] Filed: Oct. 28, 1997

Related U.S. Application Data

[60] Provisional application No. 60/030,407, Nov. 1, 1996.

[51] Int. Cl.[6] ..... A47B 53/00

[52] U.S. Cl. ..... 312/198; 312/201; 312/249.9; 211/151

[58] Field of Search ..... 312/198, 199, 312/200, 201, 249.1, 249.8, 249.11, 249.9, 130, 131, 301; 211/162, 151

[56] References Cited

U.S. PATENT DOCUMENTS

| | | | |
|---|---|---|---|
| 1,041,700 | 10/1912 | Thornley . | |
| 3,923,354 | 12/1975 | Young | 312/198 X |
| 4,026,616 | 5/1977 | Kuehl | 312/249.9 |
| 4,058,861 | 11/1977 | Kruse | 312/314 |
| 4,061,379 | 12/1977 | Randall | 312/201 |
| 4,084,125 | 4/1978 | King | 312/201 X |
| 4,657,317 | 4/1987 | Gemma | 312/198 |
| 4,789,210 | 12/1988 | Weiss et al. | 312/201 |
| 4,826,265 | 5/1989 | Hockenberry | 312/326 |
| 5,057,977 | 10/1991 | Kurzman | 312/131 X |
| 5,072,838 | 12/1991 | Price, Jr. et al. | 312/198 X |
| 5,341,944 | 8/1994 | Latino | 211/162 |
| 5,443,312 | 8/1995 | Schluter | 312/249.9 X |
| 5,683,155 | 11/1997 | Sarno | 312/198 X |

*Primary Examiner*—Peter M. Cuomo
*Assistant Examiner*—James O. Hansen
*Attorney, Agent, or Firm*—Patterson & Keough, P.A.

[57] ABSTRACT

A music library system that is adapted for the storage of sheet music, is designed for semi-permanent installation in a room having adjoining walls and a floor and includes a frame that is fixedly, removably coupled to the floor and to at least one wall of the room. The frame defines a plurality of drawer openings. A plurality of drawers are movably supported on the floor. Each of the plurality of drawers is disposed in a retracted disposition in close proximity to at least one other drawer in a corresponding drawer opening. The drawers are extendable from the frame outwardly from the wall to an extended disposition wherein a drawer side opening is exposed. The drawer side opening provides access to the stored sheet music.

15 Claims, 4 Drawing Sheets

10
18
120
26
24a
30
17
16
26
26
18
25
36
72
24
66
52
36
14
21
82
66
74
68
70
84
58
32
22
62
20
46
54
60
32
50
34
44
46

72
14
52
68
76
76
62
58
60
50
54

MUSIC LIBRARY SYSTEM

RELATED APPLICATIONS

The present invention claims the benefit of U.S. Provisional Application No. 60/030,407 filed Nov. 1, 1996 and incorporated herein in its entirety by reference.

TECHNICAL FIELD

The present invention relates to a storage system. More particularly, the present invention relates to a storage system particularly adapted for storing sheet music.

BACKGROUND OF THE INVENTION

There is a need in the industry for a space efficient and readily accessible system for storing sheet music. An average band, orchestra, or choir with one thousand titles requires substantial storage space. Storage for the sheet music is typically done in four-drawer file cabinets. A disadvantage of four-drawer file cabinets is that more than a dozen of such cabinets is required to store the sheet music for the aforementioned one thousand titles. A dozen four-drawer file cabinets take up eighteen feet of wall space.

Another means of storing such sheet music is in side-by-side, laterally translatable shelves. Such laterally translatable shelves have the disadvantage of always having enough space between at least two of the shelves in order for a person to walk into the space to retrieve stored materials. Additionally, the side-by-side type design requires an extensive track system that is permanently affixed to the floor.

SUMMARY OF THE INVENTION

The music library system of the present invention substantially meets the aforementioned needs. The present music library system permits storage of the same amount of sheet music that may be stored in more than a dozen four-drawer file cabinets in a system that takes up less than seven feet of wall space. Further, a great number of titles may be systematically organized and readily viewed when stored in the music library system for rapid retrieval. This systemization substantially deceases the amount of time spent in searching for specific titles.

The music library system of the present invention is readily movable and may be readily installed over floors surfaced with industrial carpet, wood, and tile. Preferably, the frame of the music library system is constructed of ⅞ inch tubular steel and the shelves are formed of plywood-core material featuring a protective polyester laminate. Each unit is preferably 44 inches deep and 16 inches wide in the closed position. The total depth required for each unit is 80 inches to accommodate the unit in the open position.

A music library system of the present invention is adapted for the storage of sheet music and is designed for semi-permanent installation in a room having adjoining walls and a floor. The music library system includes a frame that is fixedly, removably coupled to the floor and to at least one wall of the room. The frame defines a plurality of drawer openings. A plurality of drawers are movably supported on the floor. Each of the plurality of drawers is disposed in a retracted disposition in close proximity to at least one other drawer in a corresponding drawer opening. The drawers are extendable from the frame outwardly from the wall to an extended disposition wherein a drawer side opening is exposed. The drawer side opening provides access to the stored sheet music.

DETAILED DESCRIPTION OF THE DRAWINGS

Figure 1:
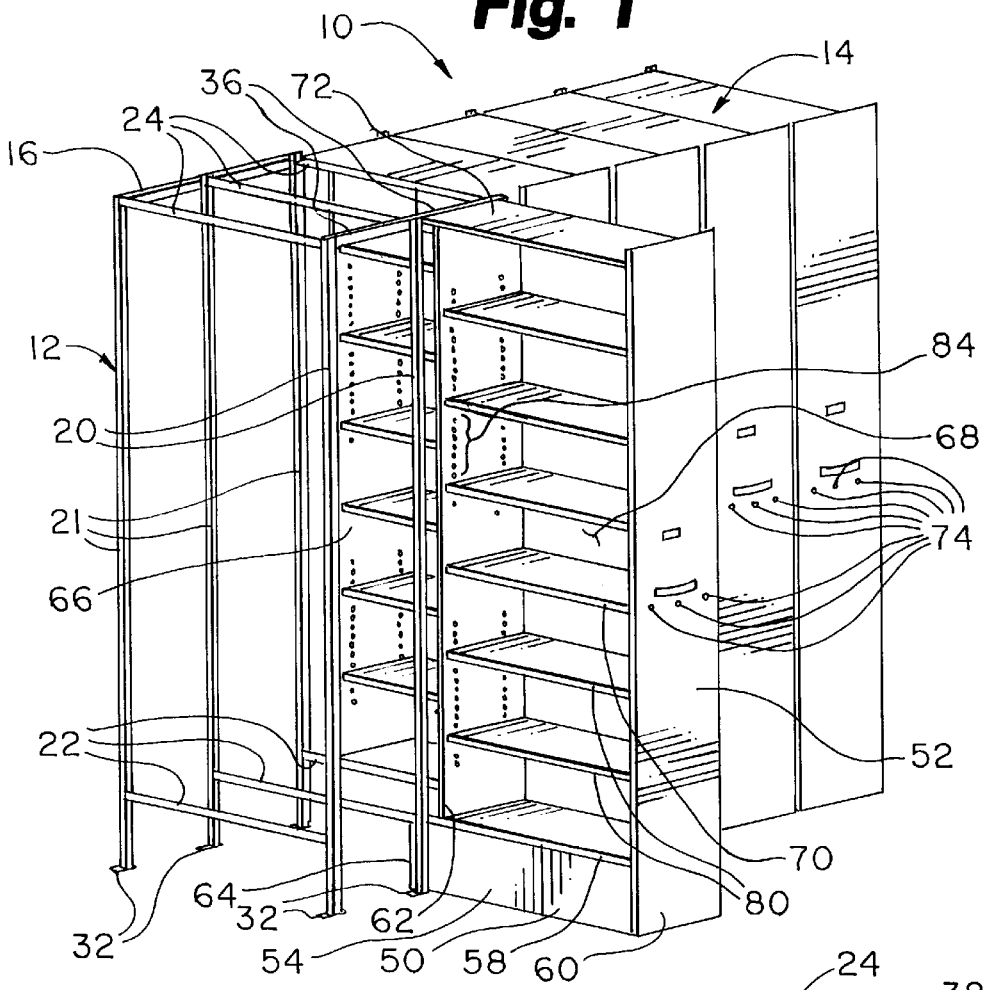
FIG. 1 is a perspective view of the music library system of the present invention with a drawer in the extended disposition.

The music library system of the present invention is shown generally at 10 in the figures. As depicted in FIG. 1, the music library system 10 has two major components: frame 12 and drawers 14.

The frame 12 includes a wall channel 16. The wall channel 16 is securely affixed to the rear wall 17 of the room in which the music library system 10 is installed. Wall channel 16 is preferably affixed to the rear wall 17 by screws 18 that are passed through bores (not shown) defined in a wall channel 16 and then threadedly engaged with a stud supporting the rear wall 17. Alternatively, where the rear wall 17 is a masonry wall, the wall channel 16 may be affixed to the rear wall 17 by the use of screws 18 turned into fiber anchors (not shown) driven into bores (not shown) defined in the masonry rear wall 17. The installation is semi-permanent. Removal of the music library system 10 is simply the reverse of the installation procedures and is relatively easily accomplished.

The plurality of front upright standards 20 and rear upright standards 21 provide the vertical support of the frame 12. Each front standard 20 is paired with a rear standard 21. The paired standards 20, 21 are each connected with a lower cross brace 22 and an upper cross brace 24. The frame 12 is preferably formed of relatively small section aluminum or steel tubes. The relatively small size is made possible by the fact that the frame 12 does not support any of the mass of the drawers 14. The drawers 14 are supported by the floor of the room in which the music library system 10 is installed.

In order to increase the stability of the music library system 10, it is helpful to install the music library system 10 in a corner of a room, where the music library system 10 may be tied into the adjoining walls of the room. Accordingly, the wall side upper cross brace 24*a* is secured to the sidewall 25 by screws 26 in a manner similar to that previously described with respect to the wall channel 16. An alternative means of attachment of the wall side up across brace 24*a* to the sidewall 25 is by means of an L-shaped bracket 30. A leg of the bracket 30 is positioned flush with the underside of the wall side up across brace 24*a* and affixed thereto by means of a screw. The second leg of the bracket 30 is positioned flush with the sidewall 25 and affixed thereto by means of a screw as previously described. The bracket 30 has the advantage of being able to position the wall side upper cross brace 24*a* a slight distance away from the sidewall 25 while still firmly affixing the frame 12 to the sidewall 25.

Each of the standards 20, 21 has a foot 32. The foot 32 may be affixed to the floor of the room in which the music library system 10 is installed by means of a single screw through one of the two bores 34 provided in the foot 32. Where the floor is a wood floor, the screw may be turned directly into the wood. Where the floor is concrete, the screw may be turned into a fiber anchor as previously described. While two bores 34 are depicted in each foot 32, it is usually only necessary to use a single screw in a single bore 34 to adequately secure the foot 32 to the floor.

Figure 2:
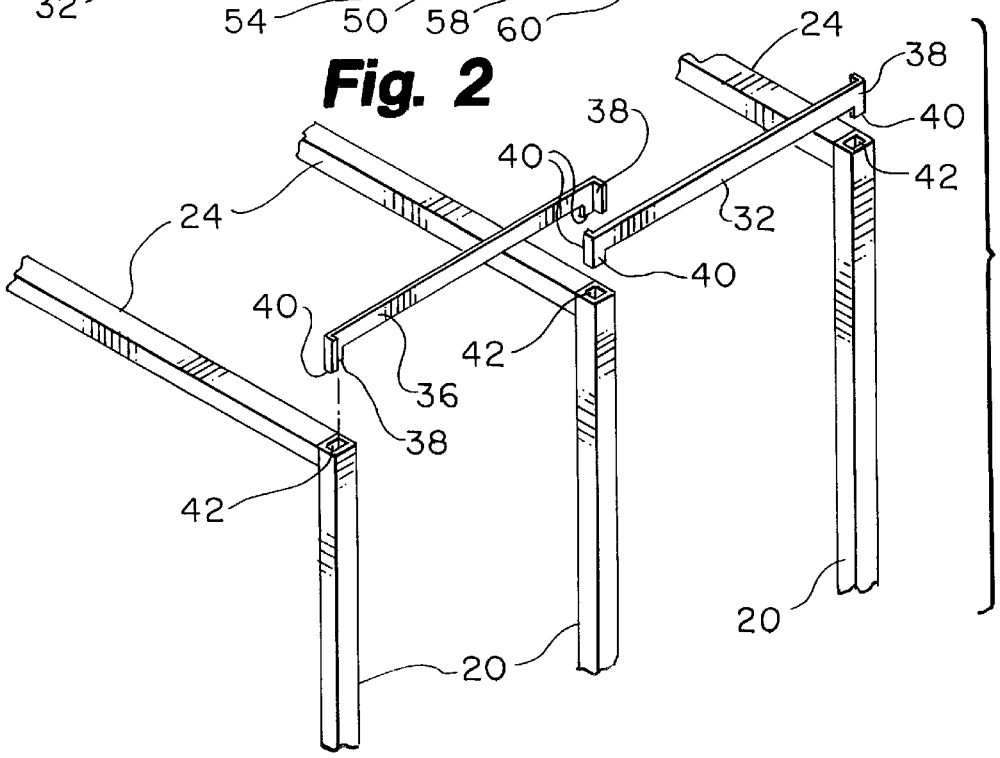
FIG. 2 is a perspective view of the frame of the music library system with the tie bars depicted in an exploded relationship thereto.

As depicted in FIG. 2, tie bars 36 are utilized to couple adjacent front standards 20 to each other. The tie bars 36 have L-shaped opposed ends 38. Each of the L-shaped ends 38 has a depending locking tab 40. The locking tab 40 is designed to be inserted in the aperture 42 defined in the front standard 20. It should be noted that the L-shaped ends 38 of alternate tie bars 36 are reversed so that the locking tab 40 of two tie bars 36 may be inserted in a single aperture 42 of a front standard 20. This usage is evident in viewing the center front standard 20 depicted in FIG. 2.

Figure 3:
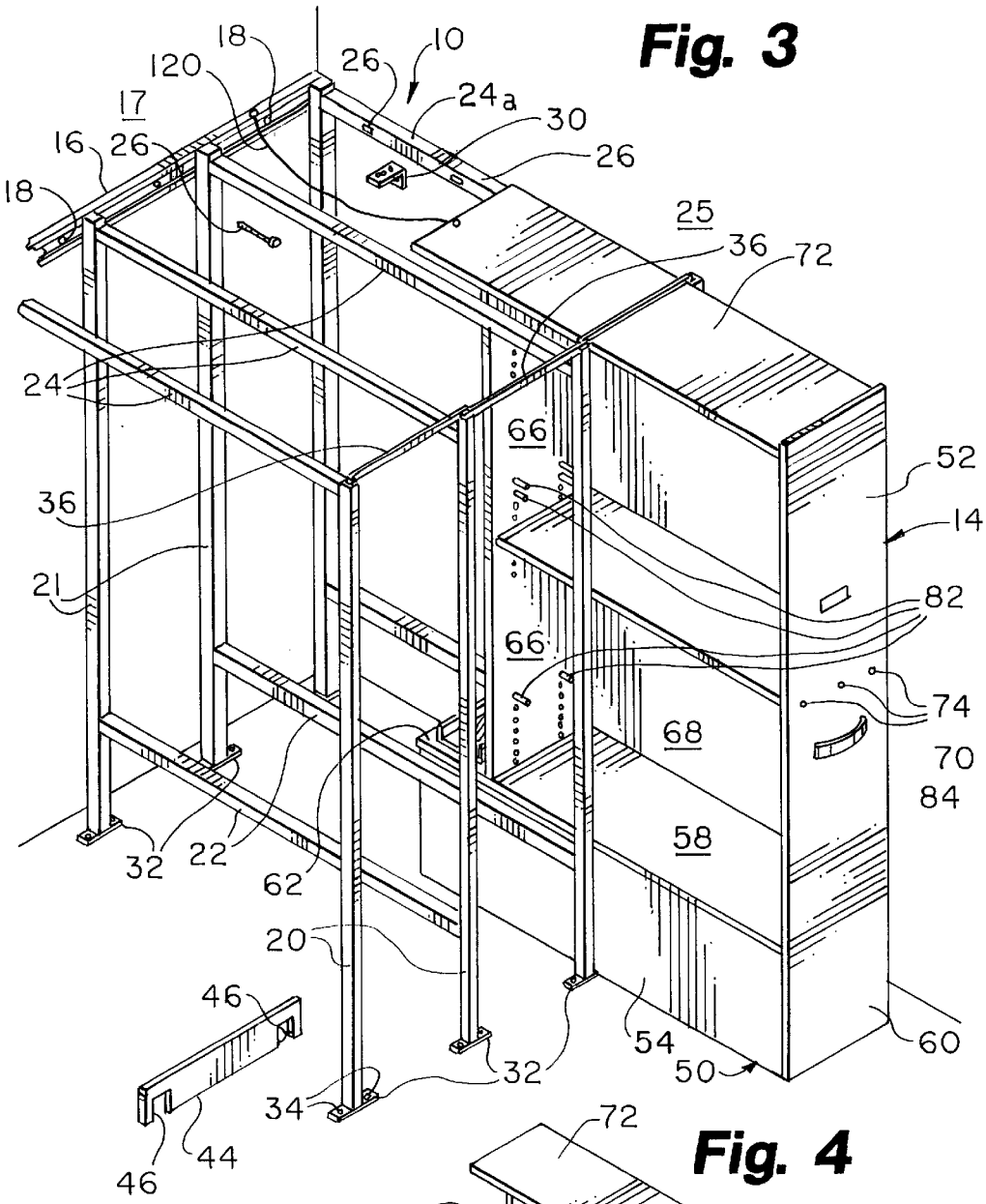
FIG. 3 is a perspective view of the frame of the music library system with a single drawer in a partially extended disposition.

As depicted in FIG. 3, a spacer bar 44 may be provided in order to assist in the erection of the music library system 10 at the site in which it is installed. The spacer bar 44 is utilized to ensure that the spacing between adjacent front standards 20 and between adjacent rear standards 21 is the proper distance for accommodating the drawers 14. The spacer bar 44 has a pair of spaced apart cross brace cutouts 46 defined therein. The cross brace cutouts 46 are spaced apart the precise distance that adjacent front standards 20 and rear standards 21 should be apart. By placing the spacer bar over adjacent lower cross braces 22, the correct distance between adjacent front standards 20 and between adjacent rear standards 21 may be properly set prior to affixing the foot 32 thereof to the floor.

Figure 4:
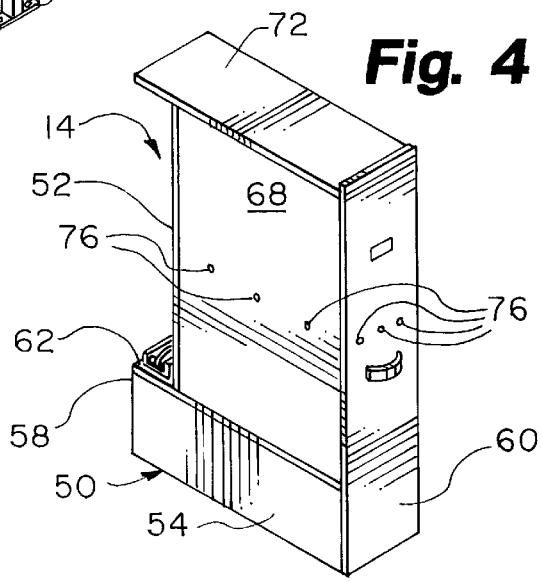
FIG. 4 is a perspective view of the rear portion of a drawer of the music library system.

Each of the drawers 14 has two major components: base 50 and shelf unit 52. The base 50 of the drawers 14 is depicted in FIGS. 1, 3, and 4, with detail presented in FIGS. 5 and 9. Referring to FIG. 3, the base 50 has a front panel 54 that extends downward from the open side of the shelf unit 52, a rear panel 56 (viewable in FIGS. 5 and 9), a top panel 58, the upper surface of which forms the bottom shelf of the shelf unit 52, a full side panel 60, which forms both the side of the shelf unit 52 and of the base 50, and an inner side panel 64 (viewable in FIGS. 5 and 9). The base 50 has a greater depth than the shelf unit 52. Accordingly a step 62 is formed by a portion of the top panel 58 at the inner side of the base 50. The bottom of the base 50 is open.

The shelf unit 52 is formed integral with portions of the base 50. The shelf unit 52 has an inner side panel 66 that extends upward from the top panel 58 of the base 50. A rear panel 68 is designed to be installed on either side of a shelf unit 50. This flexibility is evident in FIGS. 3 and 4 where the rear panel 68 has been reversed from the disposition depicted in FIG. 3 to the disposition depicted in FIG. 4.

A top panel 72 extends inward from the full side panel 60. A portion of the top panel 72 overlies the step 62 formed by the base 50.

A structural shelf 70 is included within the shelf unit 52. The structural shelf 70 is utilized to increase the structural rigidity of the shelf unit 52. Accordingly, the structural shelf 70 is affixed to the full side panel 60, the rear panel 68, and the inner side panel 66 by screws 74 passed through bores 76 defined in the aforementioned panels. A plurality of adjustable shelves 80 are supported on pegs 82. The pegs 82 are supported in peg holes 84 defined in the inner directed side of the full side panel 60 and of the inner side panel 66.

Figure 9:
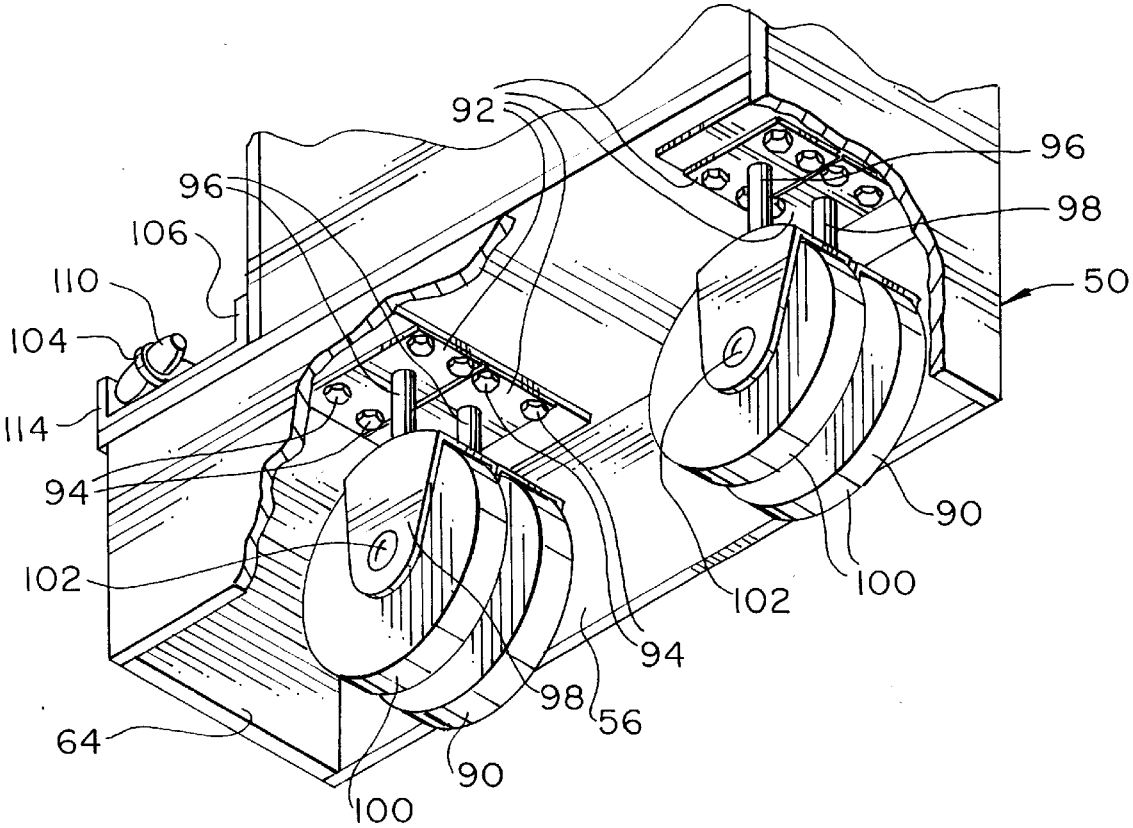
FIG. 9 is a perspective view of the lower portion of a drawer of the music library system, broken away to reveal the wheel trucks mounted therein.

Referring to FIG. 9, the shelf unit 52 is supported on two trucks 90. The trucks 90 are substantially concealed within the base 50. Each of the trucks 90 has a pair of mounting plates 92. The mounting plates 92 are bolted to the underside of the top panel 58 of the base 50 by leg bolts 94. A fixed shaft 96 depends from each of the mounting plates 92. The fixed shaft 96 is preferably fixedly coupled to a wheel mount 98. Each wheel mount 98 rotatably supports a wheel 100 on an axle 102. The ground engaging wheels 100 are visible in FIG. 7.

Figure 5:
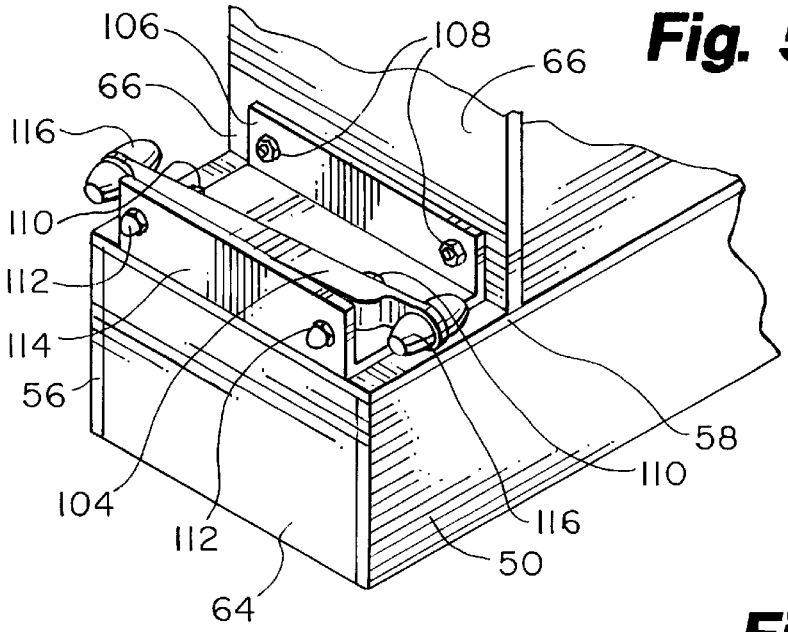
FIG. 5 is a perspective view of the bumper bar disposed on a drawer of the music library system.
Figure 6:
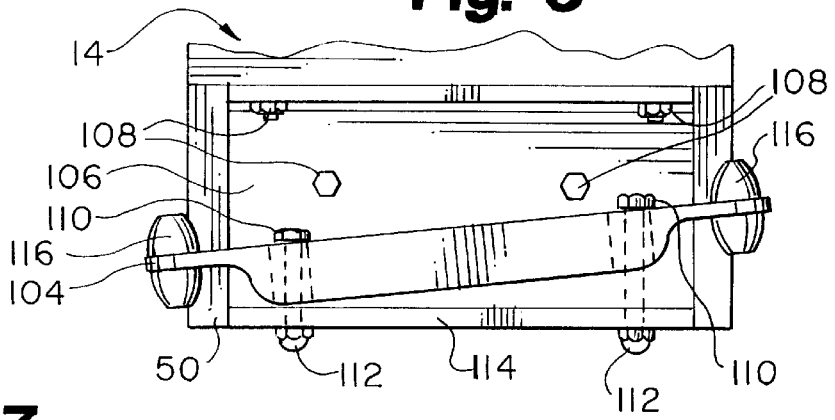
FIG. 6 is a top elevational view of the bumper bar of FIG. 5.

Two means of restraint are provided in order to prevent a user from pulling a drawer 14 free from the frame 12. The first of such restraints is the bumper bar 104, as depicted in FIGS. 5 and 6. The bumper bar 104 is mounted on a channel bracket. The channel bracket 106 is in turn affixed to both the top panel 58 and the inner side panel by bolts 108. The bumper bar 104 is mounted to the inner most upright portion 114 of the channel bracket 106 by bolts 110 and nuts 112. The bumper bar 104 is preferably longer than the width of the base 50 and is mounted such that both ends of the bumper bar 104 project beyond the base 50. Each end of the bumper bar 104 has a resilient bumper 116 mounted thereto.

As depicted in FIG. 6, the bumper bar 104 is offset. In FIG. 6, the large opening that provides access to the shelf unit 52 is to the right and the rear panel 68 is to the left. The offsetting of the bumper bar 104 places the resilient bumper 116 that is on the right side of the bumper bar 104 in the leading position when the drawer 14 is withdrawn from the frame 12.

Figure 7:
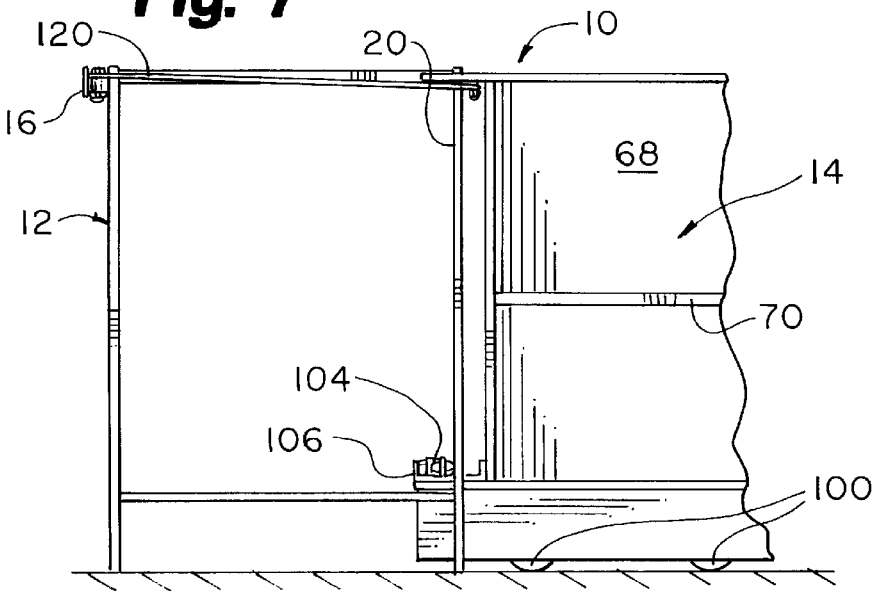
FIG. 7 is a side elevational view of the frame in a drawer of the music library system.
Figure 8:
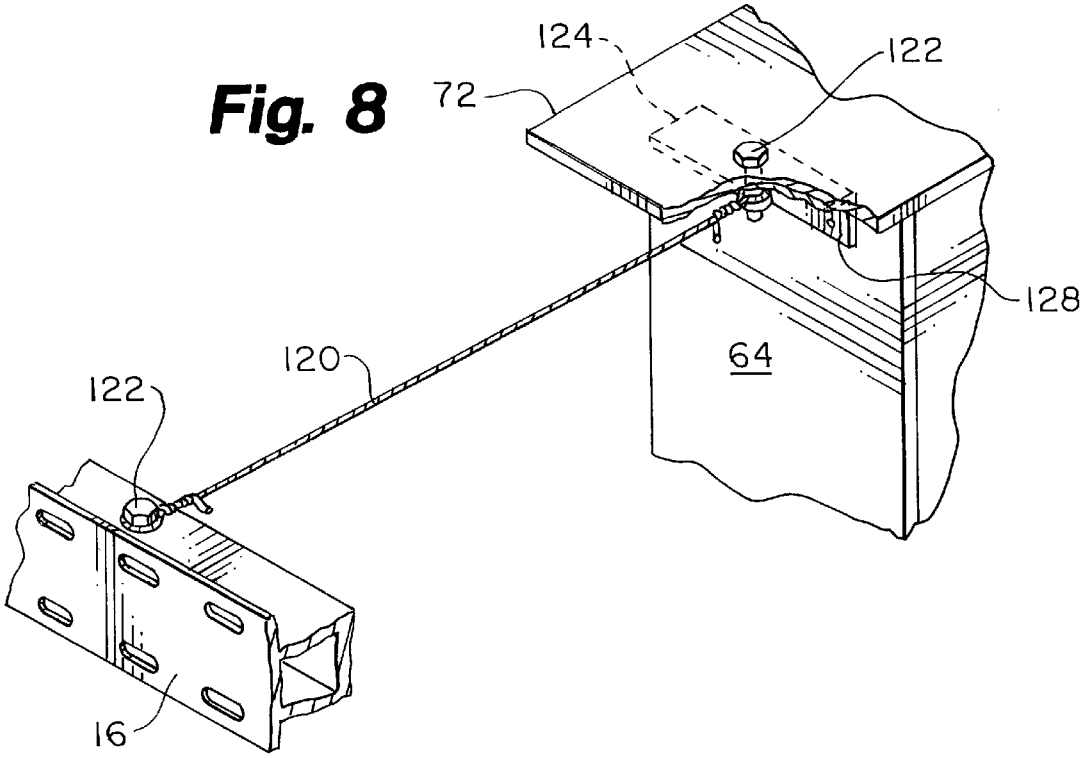
FIG. 8 is a perspective view of the cable stop coupled to a drawer of the music library system.

The second restraint is a stop cable 120. Detail of the stop cable 120 is depicted in FIG. 8. The stop cable 120 is affixed at a first end by a bolt 122 to the wall channel 16. The stop cable 120 is affixed at its second end by a bolt 126 that passes through the top panel 72 and a bracket 128 that is positioned in the angle formed by the inner side panel 64 and the underside of the overhang of the top panel 72. As depicted in FIG. 7, the length of the stop cable 120 is such that the stop cable 120 becomes taut at substantially the same point of withdrawal of the drawer 14 from the frame 14 that causes the leading offset resilient bumper 116 to come into contact with the front standard 20 that is positioned on the open side of the drawer 14. Accordingly, the outward travel of the drawer 14 with respect to the frame 12 is arrested both at the top of the drawer 14 and at the bottom of the drawer 14 substantially simultaneously.

While the preferred embodiment of the present invention has been illustrated and described herein, it is to be understood that the invention is not limited to the precise construction so illustrated and described. Accordingly, it is intended that the scope of the present invention be dictated by the scope of the appended claims and not by the description of the preferred embodiment.

What is claimed is:

1. A music library system adapted for the storage of sheet music, comprising:

a frame having a plurality of upright vertical support members, the vertical support members defining a plurality of drawer openings therebetween, a drawer opening being defined by a first pair of front and rear spaced apart vertical support members and a second pair of front and rear spaced apart vertical support members, first pair of vertical support members being spaced apart from the second pair of vertical support members; and a plurality of drawers being movably supportable on a supporting floor, each of the plurality of drawers being disposable in a corresponding drawer opening, the drawers being extendable from the frame to expose a side opening, the opening providing access for storing sheet music therein.

2. The music library system as claimed in claim 1 further including restraint means for limiting the amount of travel that a drawer may be extended from the frame.

3. The music library system as claimed in claim 2 wherein the restraint means includes a cable stop corresponding to each of the plurality of drawers, each cable stop having a first end operably coupled to the frame and a second end operably coupled to the corresponding drawer.

4. The music library system as claimed in claim 2 wherein the restraint means includes a resilient bumper, the resilient bumper being operably coupled to the drawer and abutting an upright standard to arrest the extension of the drawer from the frame.

5. The music library system as claimed in claim 1 wherein a moveable support of each of the plurality of drawers is provided by a plurality of floor engaging wheels, the wheels being operably coupled to a selected drawer of the plurality of drawers.

6. The music library system as claimed in claim 5 wherein the moveable support of each of the plurality of drawers is provided by a pair of spaced apart trucks, each truck having a plurality of floor engaging wheels operably coupled thereto and being operably coupled to a selected drawer of the plurality of drawers.

7. The music library system as claimed in claim 1 wherein each of the plurality of drawers has a plurality of shelves disposed therein, at least one of said shelves being operably fixedly coupled thereto for providing structural support to the drawer.

8. The music library system as claimed in claim 1 wherein each of the plurality of drawers is shiftable between a retracted disposition with respect to the frame and an extended disposition with respect to the frame, the side opening of each of the plurality of drawers being substantially hidden from view when the drawer is in the retracted disposition.

9. A music library system adapted for the storage of sheet music, for semi-permanent installation in a room, the room having adjoining walls and a floor, comprising:

a frame being semi-permanently couplable to a supporting floor and being couplable to at least one adjoining room wall, the frame defining a plurality of drawer openings, the frame including a plurality of upright standards, the upright standards being paired, the pairs of upright standards being spaced apart to define the plurality of drawer openings therebetween, each of the pairs of upright standards including a rear standard being disposed proximate the wall and a front standard being disposed proximate a front margin of the music library system, adjacent front standards being tied together by a removable tie bar; and a plurality of drawers being movably supportable on the floor, each of the plurality of drawers being disposed in a retracted disposition in close proximity to at least one other drawer in a corresponding drawer opening, the drawers being extendable from the frame outwardly from the wall to an extended disposition wherein a drawer side opening is exposed, the drawer side opening providing access for storing sheet music.

10. A music library system adapted for the storage of sheet music, for semi-permanent installation in a room, the room having adjoining walls and a floor, comprising:

a frame being semi-permanently couplable to a supporting floor and being couplable to at least one adjoining room wall, the frame defining a plurality of drawer openings, the frame including a plurality of upright standards, the upright standards being paired, the pairs of upright standards being spaced apart to define the plurality of drawer openings therebetween, the front upright standard of each pair of upright standards being operably coupled to the rear upright standard of each pair of upright standards by a plurality of cross braces; and a plurality of drawers being movably supportable on the floor, each of the plurality of drawers being disposed in a retracted disposition in close proximity to at least one other drawer in a corresponding drawer opening, the drawers being extendable from the frame outwardly from the wall to an extended disposition wherein a drawer side opening is exposed, the drawer side opening providing access for storing sheet music.

11. A music library system adapted for the storage of sheet music, for semi-permanent installation in a room, the room having adjoining walls and a floor, comprising:

a frame being semi-permanently couplable to a supporting floor and being couplable to at least one adjoining room wall, the frame defining a plurality of drawer openings, the frame including a plurality of upright standards, the upright standards being paired, the pairs of upright standards being spaced apart to define the plurality of drawer openings therebetween, the frame further including a wall channel, the wall channel being fixedly couplable to the wall, a plurality of vertical support members being fixedly coupled to the wall channel; and a plurality of drawers being movably supportable on the floor, each of the plurality of drawers being disposed in a retracted disposition in close proximity to at least one other drawer in a corresponding drawer opening, the drawers being extendable from the frame outwardly from the wall to an extended disposition wherein a drawer side opening is exposed, the drawer side opening providing access for storing sheet music.

12. A music library system adapted for the storage of sheet music, comprising:

a frame being semi-permanently couplable to a room floor and to at least one adjacent room wall, the frame having a plurality of upright standards, the standards being spaced apart to define a plurality of drawer openings therebetween; and a plurality of drawers being movably supportable on the floor, each of the plurality of drawers being disposed in a corresponding drawer opening, the drawers being extendable from the frame to expose a side opening, the opening providing access to the sheet music stored therein, restraint means for limiting the amount of travel that a drawer may be extended from the frame, the restraint means including a cable stop corresponding to each of the plurality of drawers, each cable stop having a first end operably coupled to the frame and a second end operably coupled to the corresponding drawer.

13. A music library system adapted for the storage of sheet music, comprising:

a frame being semi-permanently couplable to a room floor and to at least one adjacent room wall, the frame having a plurality of upright standards, the standards being spaced apart to define a plurality of drawer openings therebetween; and a plurality of drawers being movably supportable on the floor, each of the plurality of drawers being disposed in a corresponding drawer opening, the drawers being extendable from the frame to expose a side opening, the opening providing access to the sheet music stored therein, restraint means for limiting the amount of travel that a drawer may be extended from the frame, the restraint means including a resilient bumper, the resilient bumper being operably coupled to the drawer and abutting an upright standard to arrest the extension of the drawer from the frame.

14. A music library system adapted for the storage of sheet music, for semi-permanent installation in a room, the room having adjoining walls and a floor, comprising:

a frame being fixedly, removably coupled to the floor and to at least one wall of the room, the frame defining a plurality of drawer openings;

a plurality of drawers being movably supported on the floor, each of the plurality of drawers being disposed in a retracted disposition in close proximity to at least one other drawer in a corresponding drawer opening, the drawers being extendable from the frame outwardly from the wall to an extended disposition wherein a drawer side opening is exposed, the drawer side opening providing access to the stored sheet music; and restraint means for limiting the amount of travel that a drawer may be extended from the frame, the restraint means including a cable stop corresponding to each of the plurality of drawers, each cable stop having a first end operably coupled to the frame and a second end operably coupled to the corresponding drawer.

15. A music library system adapted for the storage of sheet music, for semi-permanent installation in a room, the room having adjoining walls and a floor, comprising:

a frame being fixedly, removably coupled to the floor and to at least one wall of the room, the frame defining a plurality of drawer openings;

a plurality of drawers being movably supported on the floor, each of the plurality of drawers being disposed in a retracted disposition in close proximity to at least one other drawer in a corresponding drawer opening, the drawers being extendable from the frame outwardly from the wall to an extended disposition wherein a drawer side opening is exposed, the drawer side opening providing access to the stored sheet music; and restraint means for limiting the amount of travel that a drawer may be extended from the frame, the restraint means including a resilient bumper, the resilient bumper being operably coupled to the drawer and abutting a portion of the frame to arrest the extension of the drawer from the frame.

* * * * *